US012084926B1

(12) United States Patent
Amoudi et al.

(10) Patent No.: US 12,084,926 B1
(45) Date of Patent: Sep. 10, 2024

(54) REMEDYING LOST CIRCULATION

(71) Applicant: Saudi Arabian Oil Company, Dhahran (SA)

(72) Inventors: Ahmad A. Amoudi, Al Madinah (SA); Abdulhadi Almarri, Hafuf (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/479,540

(22) Filed: Oct. 2, 2023

(51) Int. Cl.
*E21B 43/34* (2006.01)
*E21B 21/00* (2006.01)

(52) U.S. Cl.
CPC ..... *E21B 21/003* (2013.01)

(58) Field of Classification Search
CPC ..... E21B 21/003; E21B 43/34; C09K 8/38
USPC ..... 175/72
See application file for complete search history.

(56) References Cited

U.S. PATENT DOCUMENTS

| | | | | |
|---|---|---|---|---|
| 10,941,327 | B2 | 3/2021 | Arfaj et al. | |
| 2006/0231255 | A1* | 10/2006 | Oyler | C09K 8/508 507/229 |
| 2012/0285695 | A1* | 11/2012 | Lafferty | C09K 8/03 166/310 |
| 2014/0158354 | A1* | 6/2014 | Kumar | C04B 28/14 166/292 |
| 2019/0055454 | A1* | 2/2019 | Zielinski | C08G 18/022 |

FOREIGN PATENT DOCUMENTS

| | | |
|---|---|---|
| CA | 2734032 | 6/2016 |
| WO | WO 2014042552 | 3/2014 |

OTHER PUBLICATIONS

Alkinani, "A Comprehensive Analysis of Lost Circulation Materials and Treatments with Applications in Basra's Oil Fields, Iraq: Guidelines and Recommendations," Thesis for the degree of Master of Science in Petroleum Engineering, Missouri University of Science and Technology, 2017, 158 pages.

Alsaba et al., "Laboratory Evaluation of Sealing Wide Fractures Using Conventional Lost Circulation Materials," presented at the SPE Annual Technical Conference and Exhibition, Amsterdam, The Netherlands, Oct. 27-29, 2014, 18 pages.

Alsaba et al., "Lost Circulation Materials Capability of Sealing Wide Fractures," presented at the SPE Deepwater Drilling and Completions Conference, Galveston, Texas, Sep. 10-11, 2014, 12 pages.

Zhong et al., "Mitigation of Lost Circulation in Oil-Based Drilling Fluids Using Oil Absorbent Polymers" Materials, Oct. 2018, 20 pages.

* cited by examiner

*Primary Examiner* — William D Hutton, Jr.
*Assistant Examiner* — Ashish K Varma
(74) *Attorney, Agent, or Firm* — Fish & Richardson P.C.

(57) ABSTRACT

A solid lost circulation material is flowed into a wellbore formed in a subterranean formation to a loss zone. After flowing the solid lost circulation material into the wellbore, a plasticizer is flowed into the wellbore to the loss zone. The plasticizer is allowed to come in contact with the solid lost circulation material at the loss zone. The plasticizer causes the solid lost circulation material to become deformable and adhesive in response to contacting the solid lost circulation material. The solid lost circulation material contacted by the plasticizer forms a malleable plug that seals the loss zone. After malleable plug seals the loss zone, a fluid is circulated through the wellbore to further seal the plug against the loss zone to block fluid flow from the wellbore into the loss zone.

19 Claims, 5 Drawing Sheets

REMEDYING LOST CIRCULATION

TECHNICAL FIELD

This disclosure relates to remedying lost circulation in subterranean formations.

BACKGROUND

In oil or gas well drilling, lost circulation is an undesirable situation in which drilling fluid, also known as mud, flows into a subterranean formation instead of returning up to the surface. In partial lost circulation, mud continues to flow to the surface with some loss of mud to the formation. In total lost circulation, all of the mud flows into the formation with no return to the surface. The consequences of lost circulation can range from a loss of drilling fluid to blowout or even loss of life. Prevention of lost circulation is desirable, but because lost circulation is such a common occurrence, remediation methods can help mitigate lost circulation when it has occurred.

SUMMARY

This disclosure describes technologies relating to a deformable lost circulation material (LCM) that can be applied in subterranean formations to prevent lost circulation. Certain aspects of the subject matter described can be implemented as a method. A first solid lost circulation material is charged with a first electrical charge. The charged first solid lost circulation material is flowed into a wellbore formed in a subterranean formation to a loss zone. A second solid lost circulation material is charged with a second electrical charge that is opposite the first electrical charge. The charged second solid lost circulation material is flowed into the wellbore to the loss zone. The charged second solid lost circulation material is allowed to come in contact with and accumulate onto the charged first solid lost circulation material, wherein the accumulated charged first solid circulation material and charged second solid circulation material form a plug in the loss zone. A plasticizer is flowed into the wellbore to the loss zone. The plasticizer is allowed to come in contact with the charged second solid lost circulation material at the loss zone. The plasticizer causes the charged second solid lost circulation material to become deformable and adhesive in response to contacting the charged second solid lost circulation material. The charged second solid circulation material contacted with the plasticizer causes the plug to become malleable and seal the loss zone. After the malleable plug seals the loss zone, a fluid is circulated through the wellbore to further seal the malleable plug against the loss zone to block fluid flow from the wellbore into the loss zone.

This, and other aspects, can include one or more of the following features. In some implementations, the second solid lost circulation material includes a polymeric acid. In some implementations, the plasticizer includes acetone. In some implementations, the second solid lost circulation material includes polyethylene terephthalate. In some implementations, the plasticizer includes an ethylene-based glycol. In some implementations, an extent of lost circulation from the wellbore into the loss zone is evaluated. Evaluating the extent of lost circulation can include continuing to circulate the drilling fluid through the wellbore and measuring a loss of the drilling fluid. In some implementations, after flowing the first solid lost circulation material into the wellbore to the loss zone, the first solid lost circulation material is allowed to soak for a specified time duration sufficient to accumulate the first solid lost circulation material in at least a portion of the loss zone. In some implementations, after allowing the first solid lost circulation material to soak for the specified time duration, the drilling fluid is circulated through the wellbore to remove an excess portion of the first solid lost circulation material from the wellbore. In some implementations, after allowing the second solid lost circulation material to come in contact with the first solid lost circulation material, the drilling fluid is circulated through the wellbore to remove an excess portion of the second solid lost circulation material from the wellbore. In some implementations, charging the second solid lost circulation material with the second electrical charge includes exposing the second solid lost circulation material to an electric field having a voltage in a range of from about 2 volts (V) to about 40 V. In some implementations, charging the second solid lost circulation material with the second electrical charge includes disposing an ionic surfactant on a surface of the second solid lost circulation material. In some implementations, the ionic surfactant includes an amine, a quaternary ammonium cation, or both.

Certain aspects of the subject matter described can be implemented as a method. A solid lost circulation material is flowed into a wellbore formed in a subterranean formation to a loss zone. After flowing the solid lost circulation material into the wellbore, a plasticizer is flowed into the wellbore to the loss zone. The plasticizer is allowed to come in contact with the solid lost circulation material at the loss zone. The plasticizer causes the solid lost circulation material to become deformable and adhesive in response to contacting the solid lost circulation material. The solid lost circulation material contacted by the plasticizer forms a malleable plug that seals the loss zone. After malleable plug seals the loss zone, a fluid is circulated through the wellbore to further seal the plug against the loss zone to block fluid flow from the wellbore into the loss zone.

This, and other aspects, can include one or more of the following features. In some implementations, the solid lost circulation material includes a polymeric acid. In some implementations, the plasticizer includes acetone. In some implementations, the solid lost circulation material includes polyethylene terephthalate. In some implementations, the plasticizer includes an ethylene-based glycol. In some implementations, a first portion of the solid lost circulation material that is flowed into the wellbore is negatively charged, and a second portion of the solid lost circulation material that is flowed into the wellbore is positively charged. In some implementations, prior to flowing the solid lost circulation material into the wellbore, the second portion of the solid lost circulation material is exposed to an electric field having a voltage in a range of from about 2 volts (V) to about 40 V. In some implementations, prior to flowing the solid lost circulation material into the wellbore, an ionic surfactant is disposed on a surface of the second portion of the solid lost circulation material. In some implementations, the ionic surfactant includes an amine, a quaternary ammonium cation, or both.

Certain aspects of the subject matter described can be implemented as a system. The system includes a wellbore, a plug, a plasticizer, and a pump. The wellbore is formed in a subterranean formation having a loss zone. The plug is disposed in the loss zone of the subterranean formation. The plug includes a first solid lost circulation material and a second solid lost circulation material. The first solid lost circulation material has a negative charge. The second solid lost circulation material has a positive charge. The second solid lost circulation material is in contact with the first solid lost circulation based on an attraction between the negative charge and the positive charge of the first solid lost circulation material and the second solid lost circulation material, respectively. The plasticizer is disposed in the loss zone of the subterranean formation. The plasticizer is configured to cause the second solid lost circulation material to become deformable and adhesive in response to contacting the second solid lost circulation material to make the plug malleable and seal the loss zone. The pump is configured to flow, separately, the first solid lost circulation material, the second solid lost circulation material, and the plasticizer into the wellbore to the loss zone of the subterranean formation.

This, and other aspects, can include one or more of the following features. In some implementations, the second solid lost circulation material includes a polymeric acid. In some implementations, the plasticizer includes acetone. In some implementations, the second solid lost circulation material includes an ionic surfactant disposed on a surface of the polymeric acid. In some implementations, the ionic surfactant includes an amine, a quaternary ammonium cation, or both.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes to a deformable lost circulation material (LCM) that can be applied in subterranean formations to prevent lost circulation. The LCM is a solid (rigid) LCM when it is first flowed into the subterranean formation. The LCM can, for example, be flowed into the subterranean formation with a fluid (such as drilling fluid). A follow-up chemical is then introduced to the subterranean formation that causes the LCM to soften and become deformable. In this deformable state, the LCM can aggregate and stick together, deform to take the shape of a fracture, or both. In some implementations, the LCM is electrically charged prior to being flowed into the subterranean formation. A first portion of the LCM can be negatively charged, while a second portion of the LCM can be positively charged. The first portion of the LCM and the second portion of the LCM can be separately flowed into the subterranean formation, so that they do not stick together and be easily flowed to a desired loss zone. The first portion of the LCM and the second portion of the LCM can accumulate (via attractive electric force) within the loss zone to form a plug. The follow-up chemical (such as a plasticizer) can be introduced to make the plug malleable and seal the loss zone.

The subject matter described in this disclosure can be implemented in particular implementations, so as to realize one or more of the following advantages. The described systems and methods can remedy lost circulation in wells, even in cases in which porosity and permeability measurement values of the rock formation have been inaccurately estimated and/or a loss zone fracture has propagated. The solid LCM described can be flowed into the wellbore as small particles which can then aggregate and/or fuse together downhole at the loss zone to form a plug that fits to the desired shape of the loss zone for optimal plugging and remedying of the lost circulation in the well. In some cases, the solid LCM is oppositely charged, such that the attractive electrical forces cause the LCM to accumulate at the loss zone as opposed to accumulating in unwanted areas, such as near/at the drillstring. Introduction of a plasticizer downhole causes the once solid LCM to become deformable and/or adhesive, such that a plug that is more form-fitting to the loss zone can be formed at the loss zone.

Figure 1:
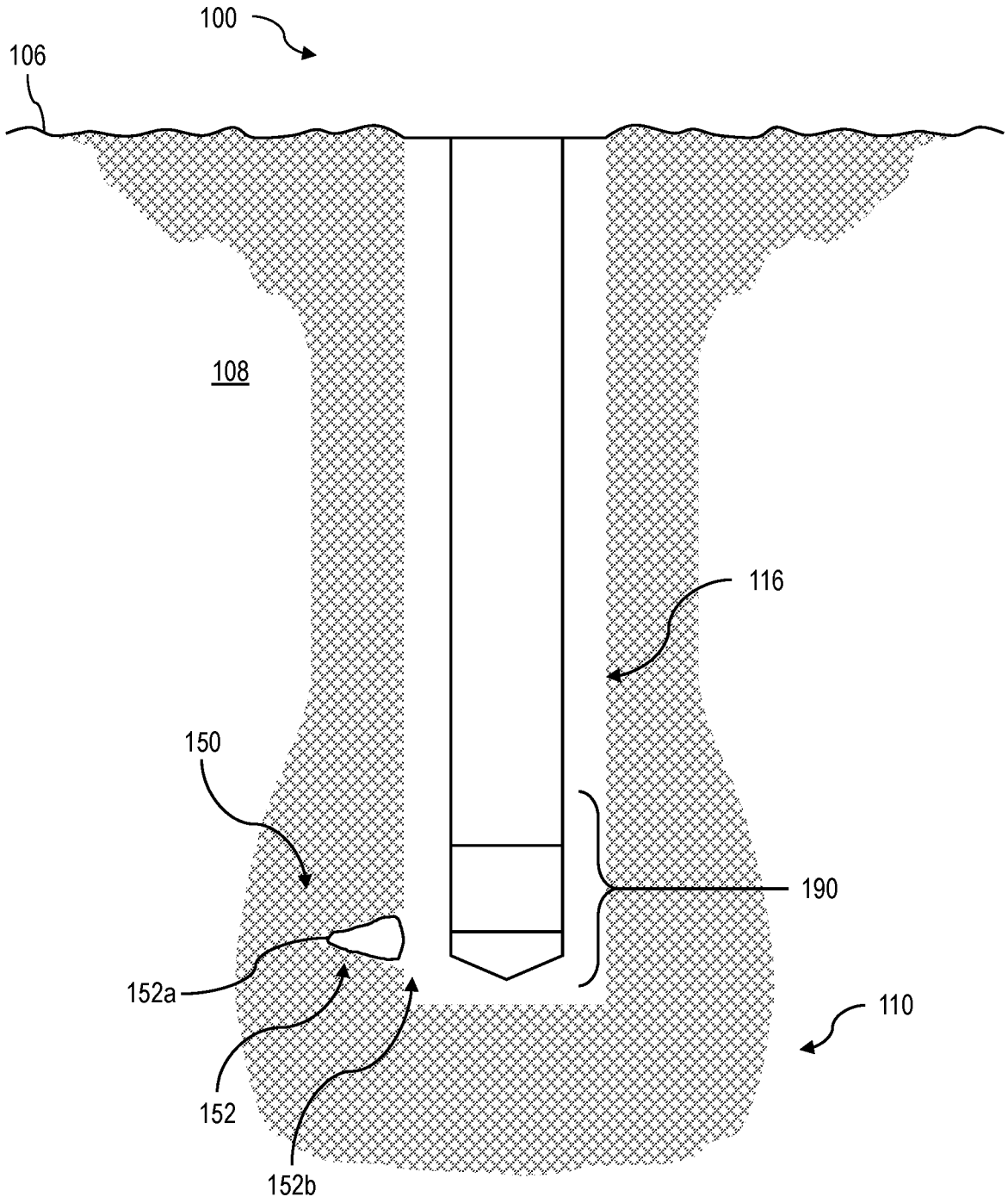
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

A drillstring can be used to drill the wellbore. The lower portion of the drillstring can include a bottomhole assembly 190. The bottomhole assembly 190 is configured to provide force to break rock, survive a hostile mechanical environment, and provide directional control of the well 100. Additionally, the construction of the components of the bottomhole assembly 190 are configured to withstand the impacts, scraping, and other physical challenges the bottomhole assembly 190 will encounter while being passed hundreds of feet/meters or even multiple miles/kilometers into and out of the well 100. Beyond just a rugged exterior, this encompasses having certain portions of any electronics being ruggedized to be shock resistant and remain fluid tight during such physical challenges and during operation. The bottomhole assembly 190 includes a drill bit positioned at an end of the bottomhole assembly 190 and is configured to rotate to cut into the subterranean formation, thereby forming the wellbore. While rotating, the drill bit scrapes rock, crushes rock, or both to form the wellbore. The drill bit can be connected to typical equipment known in the art, for example, a mud motor, a stabilizer, a near bit reamer, a measurement while drilling (MWD) tool, or a logging while drilling (LWD) tool. Drilling fluid (also referred to as drilling mud) can be circulated around the drill bit and through the wellbore to provide lubrication to the drill bit as the wellbore is formed.

The wellbore of the well 100 is typically, although not necessarily, cylindrical. All or a portion of the wellbore is lined with a tubing, such as a casing. In some implementations, the casing is omitted or ceases in the region of the subterranean zone of interest 110. This portion of the well 100 without casing is often referred to as "open hole". The wellhead defines an attachment point for other equipment to be attached to the well 100. While drilling the well 100, a loss zone 150 may be encountered. In such cases, drilling fluid is lost into the subterranean zone adjacent the loss zone 150 because the drilling fluid flows from the wellbore into the loss zone 150 instead of circulating back to the surface. In order to continue drilling safely, the loss zone 150 must be plugged to remedy the lost circulation. An LCM can be placed in the loss zone 150 to form a plug 152. The LCM can be placed in the loss zone 150, for example, by flowing the LCM with a fluid (such as the drilling fluid) through the drill bit and into the annulus between the drillstring and the wellbore wall. Flowing excess LCM can ensure that the LCM at least partially fills the loss zone 150. Fluid (such as drilling fluid) can then be circulated through the wellbore to remove excess/free-floating LCM from the wellbore. The LCM disposed within the loss zone 150 forms the plug 152. The plug 152 effectively remedies the lost circulation in the well 100 and blocks fluid from flowing into the loss zone 150. Once the plug 152 has been placed in the loss zone 150, drilling can continue, and the well 100 can be completed.

The plug 152 includes a lost circulation material 152*a*. The lost circulation material 152*a* is solid, as opposed to malleable, when the lost circulation material 152*a* is flowed into the wellbore to the loss zone 150. The lost circulation material 152*a* can be flowed into the wellbore to the loss zone 150 with a fluid (such as drilling fluid). For example, the lost circulation material 152*a* is mixed with drilling fluid and flowed together with the drilling fluid into the wellbore to the loss zone 150. The lost circulation material 152*a* can, for example, be in the form of particles, such that they can be easily flowed through the drill string into the wellbore. In some implementations, the particles of the lost circulation material 152*a* can have an average particle diameter in a range of from about 0.1 millimeters (mm) to about 10 mm. The drilling fluid can include a water-based mud (such as aqueous muds including colloidal clay, polymer, or both), an oil-based mud (such as non-aqueous muds including diesel oil or mineral oil), or a synthetic-based mud (such as an invert emulsion mud in which the internal phase includes water, while the external phase includes a synthetic fluid rather than oil). The concentration of the lost circulation material 152*a* in the drilling fluid can be adjusted based on limitations of the drilling operation. In some implementations, the mixture of the lost circulation material 152*a* and the drilling fluid has a concentration of the lost circulation material 152*a* in a range of from about 1 volume percent (vol. %) to about 30 vol. %. The lost circulation material 152*a* can fill at least a portion of the loss zone 150. An excess of the lost circulation material 152*a* can be circulated through the wellbore to ensure that the loss zone 150 is at least partially filled with the lost circulation material 152*a*. After the lost circulation material 152*a* has been placed at the loss zone 150, drilling fluid can be circulated through the wellbore to remove excess and/or free-floating lost circulation material 152*a*. The plasticizer 152*b* is flowed into the wellbore to the loss zone 150. The plasticizer 152*b* can be flowed into the wellbore to the loss zone 150 with the drilling fluid. For example, the plasticizer 152*b* is mixed with drilling fluid and flowed together with the drilling fluid into the wellbore to the loss zone 150. The concentration of the plasticizer 152*b* in the drilling fluid can be adjusted based on wellbore conditions. In some implementations, the mixture of the plasticizer 152*b* and the drilling fluid has a concentration of the plasticizer 152*b* in a range of from about 5 volume percent (vol. %) to about 20 vol. %. As another example, the plasticizer 152*b* can be a liquid that is flowed on its own (or diluted) into the wellbore to the loss zone 150. The plasticizer 152*b* comes into contact with the lost circulation material 152*a* that occupies the loss zone 150. In response to contacting the lost circulation material 152*a*, the plasticizer 152*b* causes the lost circulation material 152*a* (that was previously solid) to become deformable (malleable) and adhesive. After the plasticizer 152*b* is flowed to the loss zone 150, the plasticizer 152*b* can be allowed to soak (for example, flow into the wellbore can be ceased) for a specified time duration sufficient for the plasticizer 152*b* to contact and interact with the lost circulation material 152*a* to cause the lost circulation material 152*a* to become malleable and adhesive. Lab tests can be completed to determine the specified time duration. The plasticizer 152*b* causes the lost circulation material 152*a* to stick together to form the plug 152. Because it is malleable, the plug 152 can mold to the shape of the formation of the loss zone 150. For example, the plug 152 can fit into and fill crevices of the loss zone 150, thereby forming an effective plug for preventing fluid loss into the subterranean formation through the loss zone 150. Fluid (such as drilling fluid) can be circulated through the wellbore to further seal the plug 152 against the loss zone 150 (for example, push the plug 152 further into the loss zone 150 to form a better seal). In some implementations, the lost circulation material 152*a* includes a polymeric acid (such as polylactic acid and/or a thermoplastic elastomer), and the plasticizer 152*b* includes a base that forms adducts with the polymeric acid of the lost circulation material 152*a* (such as acetone and/or polyethylene glycol). In some implementations, the lost circulation material 152*a* includes polyethylene terephthalate (PET), and the plasticizer 152*b* includes an ethylene glycol (such as ethylene glycol or diethylene glycol). A combination of polylactic acid and polyethylene glycol for the LCM can lead to polyethylene glycol molecules to be incorporated into a polylactic acid matrix to enhance ductility and elongation at break and impact strength.

Figure 2A:
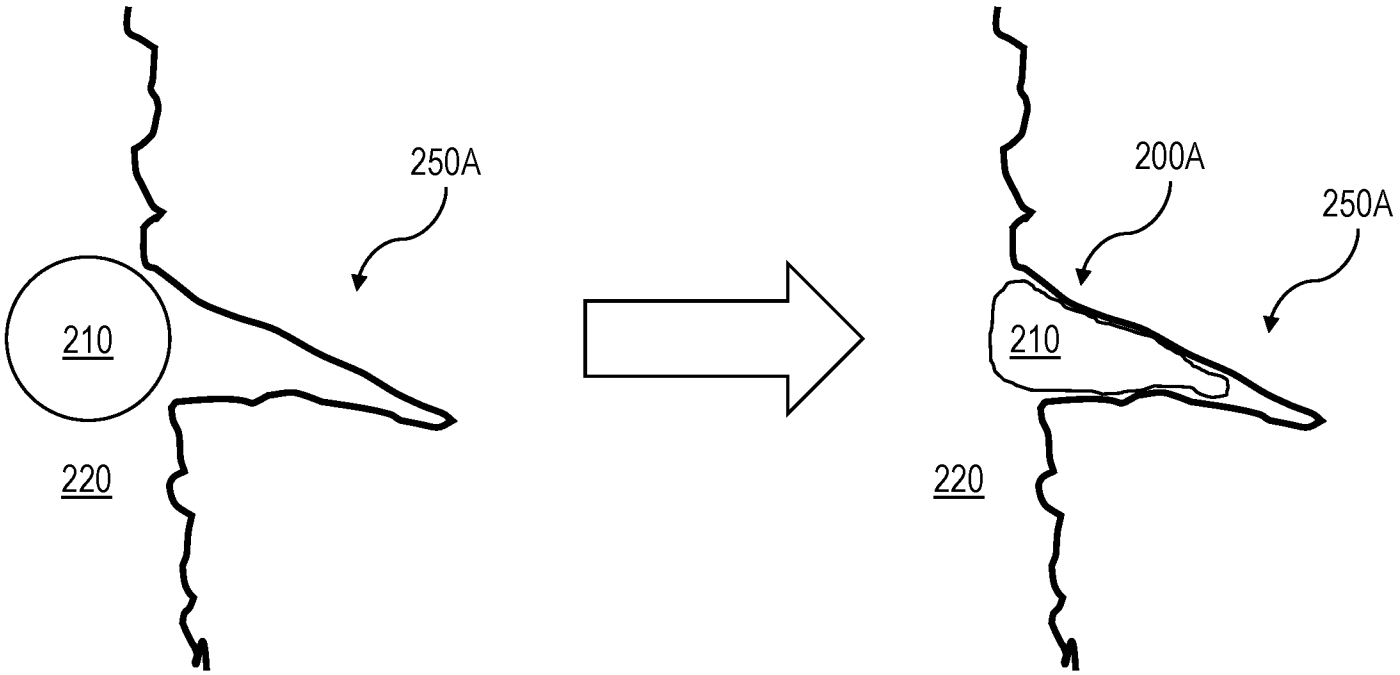
FIG. 2A is a schematic progression of a solid lost circulation material becoming deformable for fitting into a loss zone in a well.

FIG. 2A depicts a plug 200A that has been placed in a loss zone 250A in a subterranean formation. The plug 200A can be substantially similar to the plug 152. The plug 200A includes a lost circulation material 210 that has become deformable due to the presence of a plasticizer 220 in the loss zone 250A. Because the plug 200A is malleable, the plug 200A can deform to conform to the shape of the rock formation of the loss zone 250A. For example, as shown in FIG. 2A, the plug 200A can deform to at least partially fill a crevice of the loss zone 250A.

Figure 2B:
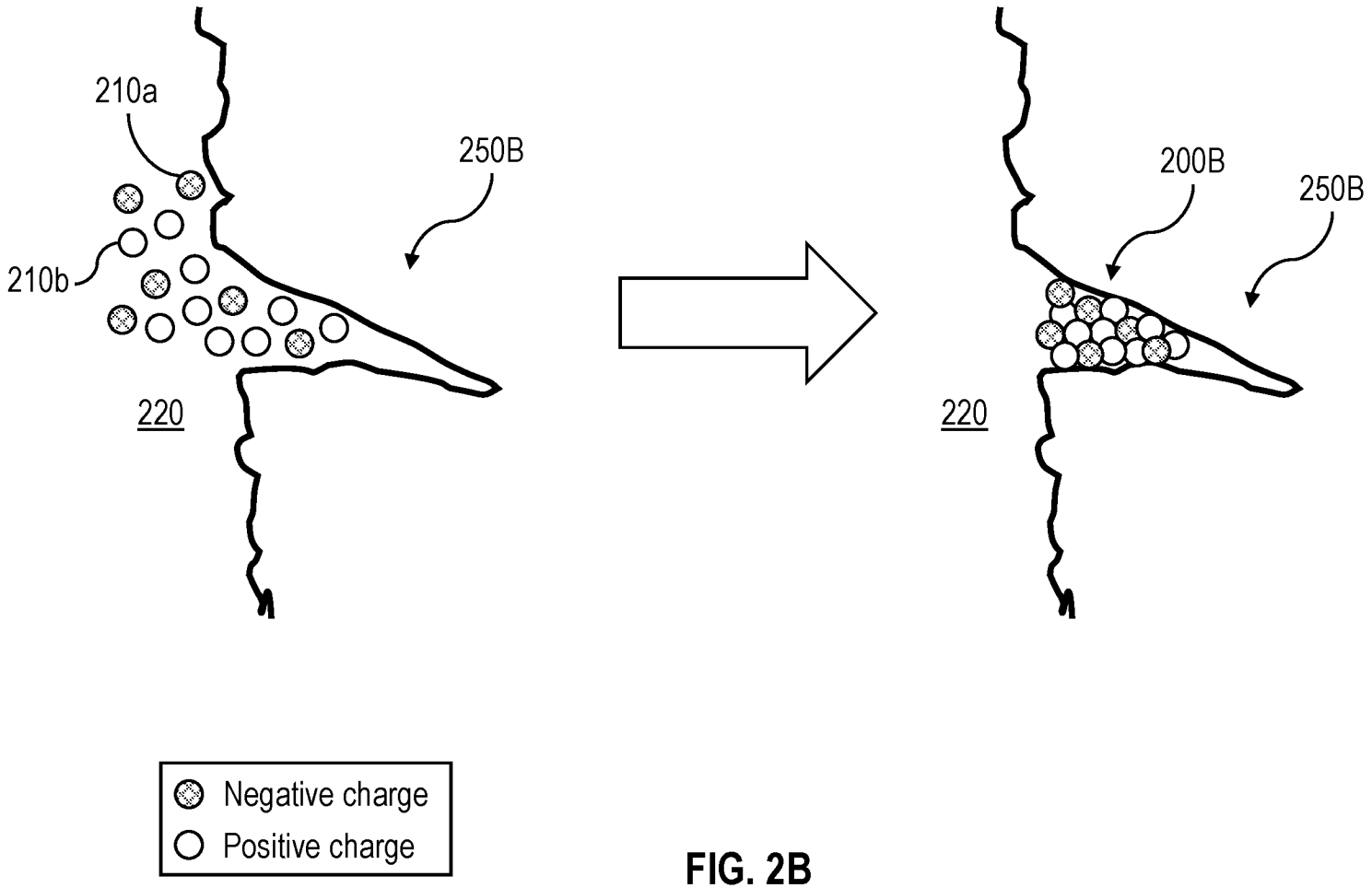
FIG. 2B is a schematic progression of a solid lost circulation material becoming deformable for fitting into a loss zone in a well.

FIG. 2B depicts a plug 200B that has been placed in a loss zone 250B. The plug 200B can be substantially similar to the plug 152. The plug 200B includes a first lost circulation material 210*a* and a second lost circulation material 210*b*. The first lost circulation material 210*a* can, for example, include a conventional lost circulation material, such as polyacrylamide. The second lost circulation material 210*b* is an implementation of the lost circulation material 152*a*. In some implementations, both the first lost circulation material 210*a* and the second lost circulation material 210*b* are implementations of the lost circulation material 152*a*. For example, both the first lost circulation material 210*a* and the second lost circulation material 210*b* are made of polylactic acid or PET.

The first lost circulation material 210*a* has an electric charge opposite that of the second lost circulation material 210*b*. For example, the first lost circulation material 210*a* has a negative charge, while the second lost circulation material 210*b* has a positive charge. As another example, the first lost circulation material 210*a* has a positive charge, while the second lost circulation material 210*b* has a negative charge. Because the first lost circulation material 210*a* and the second lost circulation material 210*b* have opposite electric charges, they are attracted to each other and aggregate to fill crevices of the loss zone 250B. At least one of the first lost circulation material 210*a* or the second lost circulation material 210*b* has become deformable and adhesive due to the presence of a plasticizer 220 in the loss zone 250B. The presence of the plasticizer 220 facilitates sticking of the first lost circulation material 210*a* and the second lost circulation material 210*b* together even after any of the first lost circulation material 210*a* or the second lost circulation material 210*b* loses its electric charge. In cases in which the first lost circulation material 210*a* and/or the second lost circulation material 210*b* includes polylactic acid, the plasticizer 220 includes acetone. In cases in which the first lost circulation material 210*a* and/or the second lost circulation material 210*b* includes PET, the plasticizer 220 includes ethylene glycol and/or diethylene glycol. Because the plug 200B is malleable, the plug 200B can deform to conform to the shape of the rock formation of the loss zone 250B. For example, as shown in FIG. 2B, the plug 200B can deform to at least partially fill a crevice of the loss zone 250B.

The first lost circulation material 210*a* and the second lost circulation material 210*b* are solid prior to being flowed into the wellbore to the loss zone 250B. The first lost circulation material 210*a* and the second lost circulation material 210*b* can be electrically charged with opposite electric charges prior to being flowed into the wellbore to the loss zone 250B. The first lost circulation material 210*a* and the second lost circulation material 210*b* are flowed separately into the wellbore to the loss zone 250B (as opposed to together, simultaneously) in order to avoid premature accumulation of the first lost circulation material 210*a* and the second lost circulation material 210*b* prior to reaching the loss zone 250B. Premature accumulation of the first lost circulation material 210*a* and the second lost circulation material 210*b* can detrimentally result in clogging the drillstring, accumulation of the LCMs on downhole tools, accumulation of the LCMs at areas other than the loss zone 250B, or any combinations of these. In some implementations, the first lost circulation material 210*a* is exposed to a first electric field having a voltage in a range of from about 2 volts (V) to about 40 V. In some implementations, the second lost circulation material 210*b* is exposed to a second electric field having a voltage in a range of from about −2 V to about −40 V. In some implementations, the first lost circulation material 210*a* is exposed to the first electric field, and an ionic surfactant is disposed on a surface of the second lost circulation material 210*b*. The ionic surfactant is a cationic surfactant, such that the second lost circulation material 210*b* is attracted to the first lost circulation material 210*a*. The ionic surfactant can include, for example, an amine (such as sodium dodecyl sulfate), a quaternary ammonium cation (such as trimethylammonium), or both. The specified time duration for soaking within the wellbore is sufficient for the lost circulation material (for example 210*a* and 210*b*) to sustain the electrical charge until the lost circulation material reaches the loss zone 250B. In some cases, the fractures of the loss zone (for example, loss zone 250B) are too large that the LCM may flow into the loss zone 250B without successfully curing (to form the plug 200B). In such cases, flowing the first lost circulation material 210*a* to form a preliminary plug and then following up with the second lost circulation material 210*b* to form a larger plug (such as the plug 200B) around the preliminary plug of the first lost circulation material 210*a* can reduce the opening(s) of the fracture(s) and successfully close off the loss zone 250B. As such, utilizing two lost circulation materials (210*a*, 210*b*) having opposite electrical charge with the plasticizer 220 (as opposed to just a single lost circulation material (210, as in FIG. 2A) can be advantageous in cases where the fractures of the loss zone are large.

Figure 3:
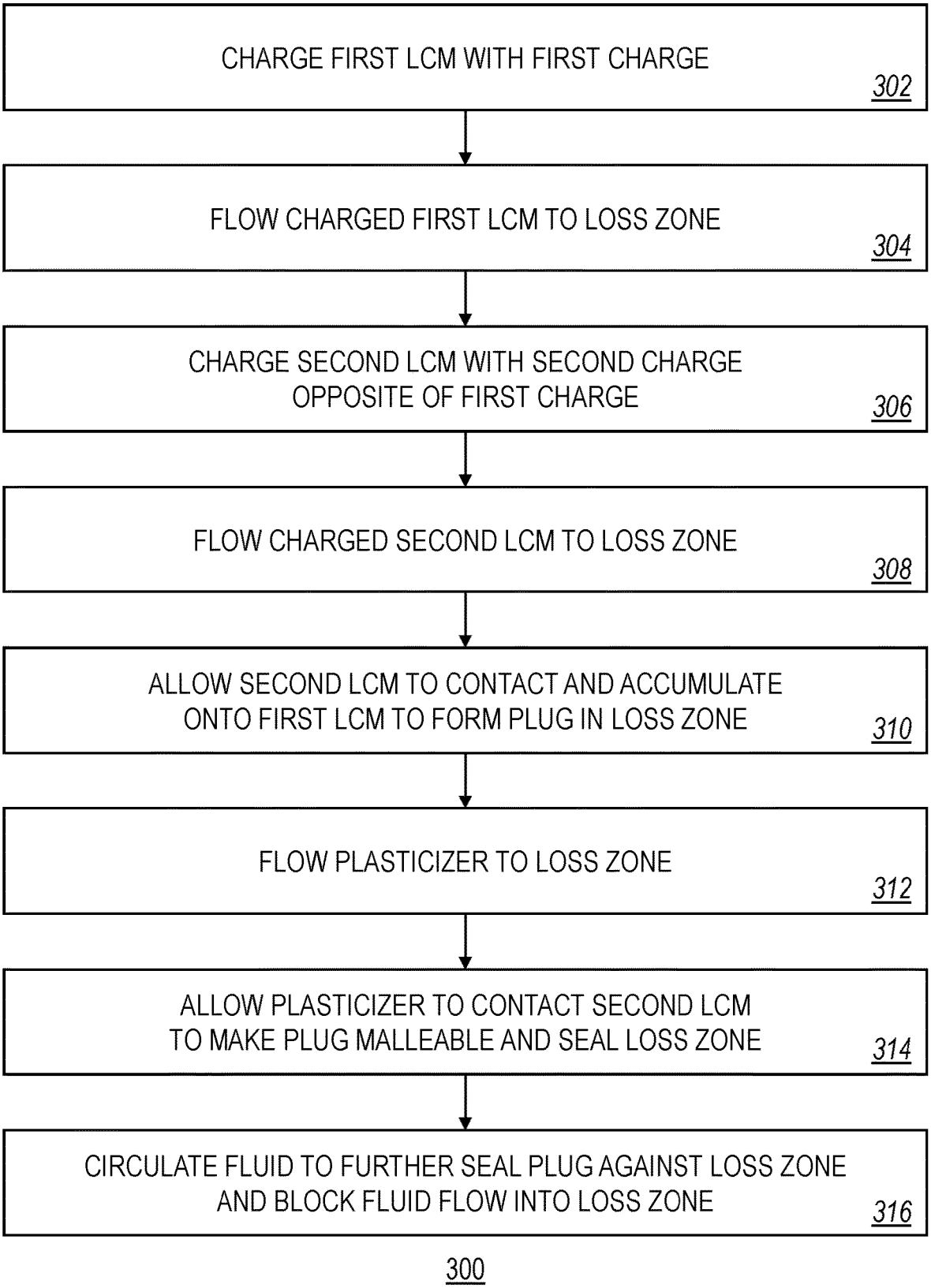
FIG. 3 is a flow chart of an example method for remedying lost circulation in a well.

FIG. 3 is a flow chart of an example method 300 for remedying lost circulation in wells (for example, in the well 100). At block 302, a first solid lost circulation material (such as the first lost circulation material 210*a*) is charged with a first electrical charge. The first lost circulation material 210*a* can be charged, for example, with a negative electric charge at block 302. The first lost circulation material 210*a* can be charged, for example, by exposing the first lost circulation material 210*a* to the first electric field at block 302. After charging the first lost circulation material 210*a* at block 302, the first lost circulation material 210*a* is flowed into a wellbore formed in a subterranean formation (such as the wellbore of the well 100) to a loss zone (such as the loss zone 250) at block 304. The first lost circulation material 210*a* can be flowed with a drilling fluid into the wellbore to the loss zone 250 at block 304. In some implementations, the mixture of the first lost circulation material 210*a* and the drilling fluid has a concentration of the first lost circulation material 210*a* in a range of from about 1 vol. % to about 30 vol. %. In some implementations, after the first lost circulation material 210*a* is flowed to the loss zone 250 at block 304, the first lost circulation material 210*a* is allowed to soak for a specified time duration that is sufficient to accumulate the first lost circulation material 210*a* in at least a portion of the loss zone 250. In some implementations, the specified time duration is in a range of from about 30 minutes to about 90 minutes. An excess of the first lost circulation material 210*a* can be circulated through the wellbore to ensure that the loss zone 250 is at least partially filled with the lost circulation material 210*a* at block 304. After the first lost circulation material 210*a* has been allowed to soak for the specified time duration, a drilling fluid can be circulated through the wellbore to remove an excess/free-floating portion of the first lost circulation material 210*a* from the wellbore.

At block 306, a second solid lost circulation material (such as the second lost circulation material 210*b*) is charged with a second electrical charge that is opposite the first electrical charge of the first lost circulation material 210*a*. The second lost circulation material 210*b* can be charged, for example, with a positive electric charge at block 306. The second lost circulation material 210*b* can be charged, for example, by exposing the second lost circulation material 210*b* to the second electric field at block 306. The second lost circulation material 210*b* can be charged, for example, by disposing an ionic surfactant on a surface of the second lost circulation material 210*b* at block 306. The ionic surfactant can be a cationic surfactant, such as an amine or a quaternary ammonium cation. After charging the second lost circulation material 210*b* at block 306, the second lost circulation material 210*b* is flowed into the wellbore to the loss zone 250 at block 308. The second lost circulation material 210*b* can be flowed with a drilling fluid into the wellbore to the loss zone 250 at block 308. In some implementations, the mixture of the second lost circulation material 210*b* and the drilling fluid has a concentration of the second lost circulation material 210*b* in a range of from about 1 vol. % to about 30 vol. %. After flowing the second lost circulation material 210*b* to the loss zone 250 at block 308, the second lost circulation material 210*b* is allowed to come in contact with and accumulate onto the first lost circulation material 210*a*, thereby forming a plug (such as the plug 200B) in the loss zone 250 at block 310. An excess of the second lost circulation material 210*b* can be circulated through the wellbore to ensure that the plug 200B is formed in the loss zone 250 at block 310. After allowing the second lost circulation material 210*b* to come in contact with the first lost circulation material 210*a* at block 310, the drilling fluid can be circulated through the wellbore to remove an excess portion of the second lost circulation material 210*b* from the wellbore. Circulating the drilling fluid at this point can prevent any excess/free-floating particles of the first lost circulation material 210*a* and/or the second lost circulation material 210*b* from sticking to unwanted portions of the well 100 (such as the drill bit and/or other downhole tools) and remove them from the wellbore.

At block 312, a plasticizer (such as the plasticizer 220) is flowed into the wellbore to the loss zone 250. At block 314, the plasticizer 250 is allowed to come in contact with the second lost circulation material 210*b* (and/or the first lost circulation material 210*a*) at the loss zone 250. Allowing the plasticizer 250 to come in contact with the second lost circulation material 210*b* (and/or the first lost circulation material 210*a*) at block 314 causes the second lost circulation material 210*b* (and/or the first lost circulation material 210*a*) to become deformable and adhesive, thereby making the plug 200B malleable, for example, for fitting into crevices of the loss zone 250 and sealing the loss zone 250. After the malleable plug 200B seals the loss zone 250 at block 314, the drilling fluid is circulated through the wellbore to further seal the malleable plug 200B into the loss zone 250 at block 316 to block fluid flow from the wellbore into the loss zone 250. For example, circulating the drilling fluid through the wellbore at block 316 can push the malleable plug 200B further into the loss zone 250 to form a better seal. In some implementations, the method 300 includes evaluating an extent of lost circulation from the wellbore into the loss zone 250 to verify that the lost circulation has been remedied. Evaluating the extent of lost circulation can include continuing to circulate the drilling fluid through the wellbore and measuring a loss of the drilling fluid. An excess loss of drilling fluid during this evaluation can signify that the lost circulation has not yet been remedied, and the method 300 can be repeated.

Figure 4:
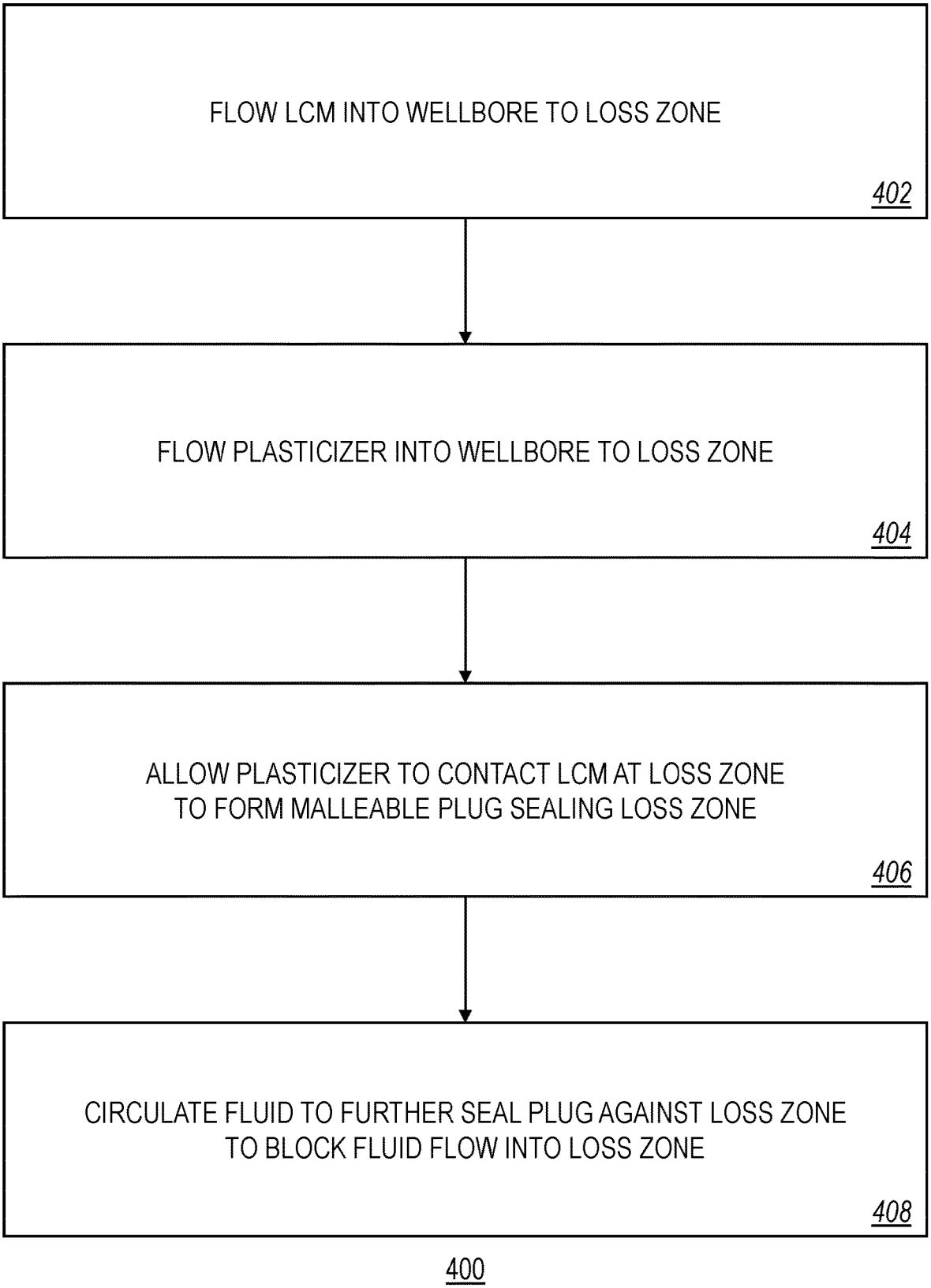
FIG. 4 is a flow chart of an example method for remedying lost circulation in a well.

FIG. 4 is a flow chart of an example method 400 for remedying lost circulation in wells (for example, in the well 100). At block 402, a solid lost circulation material (such as the lost circulation material 152*a*) is flowed into a wellbore formed in a subterranean formation (such as the wellbore of the well 100) to a loss zone (such as the loss zone 150). The lost circulation material 152*a* can be flowed with a drilling fluid into the wellbore to the loss zone 150 at block 402. In some implementations, the mixture of the lost circulation material 152*a* and the drilling fluid has a concentration of the lost circulation material 152*a* in a range of from about 1 vol. % to about 30 vol. %. After flowing the lost circulation material 152*a* into the wellbore at block 402, a plasticizer (such as the plasticizer 152*b*) is flowed into the wellbore to the loss zone 150 at block 404. At block 406, the plasticizer 152*b* is allowed to come in contact with the lost circulation material 152*a* at the loss zone 150. Allowing the plasticizer 152*b* to come in contact with the lost circulation material 152*a* at block 406 causes the lost circulation material 152*a* to become deformable and adhesive, thereby forming a plug (such as the plug 152) that is malleable, for example, for fitting into crevices of the loss zone 150 and sealing the loss zone 150. After the plug 152 seals the loss zone 150 at block 406, the drilling fluid is circulated through the wellbore to further seal the plug 152 into the loss zone 150 at block 408 to block fluid flow from the wellbore into the loss zone 150. For example, circulating the drilling fluid through the wellbore at block 408 can push the plug 152 further into the loss zone 150 to form a better seal. In some implementations, the method 400 includes evaluating an extent of lost circulation from the wellbore into the loss zone 150 to verify that the lost circulation has been remedied. Evaluating the extent of lost circulation can include continuing to circulate the drilling fluid through the wellbore and measuring a loss of the drilling fluid. An excess loss of drilling fluid during this evaluation can signify that the lost circulation has not yet been remedied, and the method 400 can be repeated.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

EMBODIMENTS

In an example implementation (or aspect), a method comprises: charging a first solid lost circulation material with a first electrical charge; flowing the charged first solid lost circulation material into a wellbore formed in a subterranean formation to a loss zone; charging a second solid lost circulation material with a second electrical charge that is opposite the first electrical charge; flowing the charged second solid lost circulation material into the wellbore to the loss zone; allowing the charged second solid lost circulation material to come in contact with and accumulate onto the charged first solid lost circulation material, wherein the accumulated charged first solid circulation material and charged second solid circulation material form a plug in the loss zone; flowing a plasticizer into the wellbore to the loss zone; allowing the plasticizer to come in contact with the charged second solid lost circulation material at the loss zone, wherein the plasticizer causes the charged second solid lost circulation material to become deformable and adhesive in response to contacting the charged second solid lost circulation material, wherein the charged second solid circulation material contacted with the plasticizer causes the plug to become malleable and seal the loss zone; and after the malleable plug seals the loss zone, circulating a fluid through the wellbore to further seal the malleable plug against the loss zone to block fluid flow from the wellbore into the loss zone.

In an example implementation (or aspect) combinable with any other example implementation (or aspect), the second solid lost circulation material comprises a polymeric acid, and the plasticizer comprises acetone.

In an example implementation (or aspect) combinable with any other example implementation (or aspect), the second solid lost circulation material comprises polyethylene terephthalate, and the plasticizer comprises an ethylene-based glycol.

In an example implementation (or aspect) combinable with any other example implementation (or aspect), the method comprises evaluating an extent of lost circulation from the wellbore into the loss zone, wherein evaluating the extent of lost circulation comprises continuing to circulate the drilling fluid through the wellbore and measuring a loss of the drilling fluid.

In an example implementation (or aspect) combinable with any other example implementation (or aspect), the method comprises: after flowing the first solid lost circulation material into the wellbore to the loss zone, allowing the first solid lost circulation material to soak for a specified time duration sufficient to accumulate the first solid lost circulation material in at least a portion of the loss zone; and after allowing the first solid lost circulation material to soak for the specified time duration, circulating the drilling fluid through the wellbore to remove an excess portion of the first solid lost circulation material from the wellbore.

In an example implementation (or aspect) combinable with any other example implementation (or aspect), the method comprises, after allowing the second solid lost circulation material to come in contact with the first solid lost circulation material, circulating the drilling fluid through the wellbore to remove an excess portion of the second solid lost circulation material from the wellbore.

In an example implementation (or aspect) combinable with any other example implementation (or aspect), charging the second solid lost circulation material with the second electrical charge comprises exposing the second solid lost circulation material to an electric field having a voltage in a range of from about 2 volts (V) to about 40 V.

In an example implementation (or aspect) combinable with any other example implementation (or aspect), charging the second solid lost circulation material with the second electrical charge comprises disposing an ionic surfactant on a surface of the second solid lost circulation material.

In an example implementation (or aspect) combinable with any other example implementation (or aspect), the ionic surfactant comprises an amine, a quaternary ammonium cation, or both.

In an example implementation (or aspect), a method comprises: flowing a solid lost circulation material into a wellbore formed in a subterranean formation to a loss zone; after flowing the solid lost circulation material into the wellbore, flowing a plasticizer into the wellbore to the loss zone; allowing the plasticizer to come in contact with the solid lost circulation material at the loss zone, wherein the plasticizer causes the solid lost circulation material to become deformable and adhesive in response to contacting the solid lost circulation material, wherein the solid lost circulation material contacted by the plasticizer forms a malleable plug that seals the loss zone; and after malleable plug seals the loss zone, circulating a fluid through the wellbore to further seal the plug against the loss zone to block fluid flow from the wellbore into the loss zone.

In an example implementation (or aspect) combinable with any other example implementation (or aspect), the solid lost circulation material comprises a polymeric acid, and the plasticizer comprises acetone.

In an example implementation (or aspect) combinable with any other example implementation (or aspect), the solid lost circulation material comprises polyethylene terephthalate, and the plasticizer comprises an ethylene-based glycol.

In an example implementation (or aspect) combinable with any other example implementation (or aspect), a first portion of the solid lost circulation material that is flowed into the wellbore is negatively charged, and a second portion of the solid lost circulation material that is flowed into the wellbore is positively charged.

In an example implementation (or aspect) combinable with any other example implementation (or aspect), the method comprises, prior to flowing the solid lost circulation material into the wellbore, exposing the second portion of the solid lost circulation material to an electric field having a voltage in a range of from about 2 volts (V) to about 40 V.

In an example implementation (or aspect) combinable with any other example implementation (or aspect), prior to flowing the solid lost circulation material into the wellbore, an ionic surfactant is disposed on a surface of the second portion of the solid lost circulation material.

In an example implementation (or aspect) combinable with any other example implementation (or aspect), the ionic surfactant comprises an amine, a quaternary ammonium cation, or both.

In an example implementation (or aspect), a system comprises: a wellbore formed in a subterranean formation having a loss zone; a plug disposed in the loss zone of the subterranean formation, wherein the plug comprises: a first solid lost circulation material having a negative charge; and a second solid lost circulation material having a positive charge, the second solid lost circulation material in contact with the first solid lost circulation based on an attraction between the negative charge and the positive charge of the first solid lost circulation material and the second solid lost circulation material, respectively; a plasticizer disposed in the loss zone of the subterranean formation, wherein the plasticizer is configured to cause the second solid lost circulation material to become deformable and adhesive in response to contacting the second solid lost circulation material to make the plug malleable and seal the loss zone; and a pump configured to flow, separately, the first solid lost circulation material, the second solid lost circulation material, and the plasticizer into the wellbore to the loss zone of the subterranean formation.

In an example implementation (or aspect) combinable with any other example implementation (or aspect), the second solid lost circulation material comprises a polymeric acid, and the plasticizer comprises acetone.

In an example implementation (or aspect) combinable with any other example implementation (or aspect), the second solid lost circulation material comprises an ionic surfactant disposed on a surface of the polymeric acid, and the ionic surfactant comprises an amine, a quaternary ammonium cation, or both.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

charging a first solid lost circulation material with a first electrical charge;

flowing the charged first solid lost circulation material into a wellbore formed in a subterranean formation to a loss zone;

charging a second solid lost circulation material with a second electrical charge that is opposite the first electrical charge;

flowing the charged second solid lost circulation material into the wellbore to the loss zone;

allowing the charged second solid lost circulation material to come in contact with and accumulate onto the charged first solid lost circulation material, wherein the accumulated charged first solid circulation material and charged second solid circulation material form a plug in the loss zone;

flowing a plasticizer into the wellbore to the loss zone;

allowing the plasticizer to come in contact with the charged second solid lost circulation material at the loss zone, wherein the plasticizer causes the charged second solid lost circulation material to become deformable and adhesive in response to contacting the charged second solid lost circulation material, wherein the charged second solid circulation material contacted with the plasticizer causes the plug to become malleable and seal the loss zone; and after the malleable plug seals the loss zone, circulating a fluid through the wellbore to further seal the malleable plug against the loss zone to block fluid flow from the wellbore into the loss zone.

2. The method of claim 1, wherein the second solid lost circulation material comprises a polymeric acid, and the plasticizer comprises acetone.

3. The method of claim 1, wherein the second solid lost circulation material comprises polyethylene terephthalate, and the plasticizer comprises an ethylene-based glycol.

4. The method of claim 1, comprising evaluating an extent of lost circulation from the wellbore into the loss zone, wherein evaluating the extent of lost circulation comprises continuing to circulate the drilling fluid through the wellbore and measuring a loss of the drilling fluid.

5. The method of claim 1, comprising:

after flowing the first solid lost circulation material into the wellbore to the loss zone, allowing the first solid lost circulation material to soak for a specified time duration sufficient to accumulate the first solid lost circulation material in at least a portion of the loss zone; and after allowing the first solid lost circulation material to soak for the specified time duration, circulating the drilling fluid through the wellbore to remove an excess portion of the first solid lost circulation material from the wellbore.

6. The method of claim 5, comprising, after allowing the second solid lost circulation material to come in contact with the first solid lost circulation material, circulating the drilling fluid through the wellbore to remove an excess portion of the second solid lost circulation material from the wellbore.

7. The method of claim 6, wherein charging the second solid lost circulation material with the second electrical charge comprises exposing the second solid lost circulation material to an electric field having a voltage in a range of from about 2 volts (V) to about 40 V.

8. The method of claim 6, wherein charging the second solid lost circulation material with the second electrical charge comprises disposing an ionic surfactant on a surface of the second solid lost circulation material.

9. The method of claim 8, wherein the ionic surfactant comprises an amine, a quaternary ammonium cation, or both.

10. A method comprising:

flowing a solid lost circulation material into a wellbore formed in a subterranean formation to a loss zone;

after flowing the solid lost circulation material into the wellbore, flowing a plasticizer into the wellbore to the loss zone;

allowing the plasticizer to come in contact with the solid lost circulation material at the loss zone, wherein the plasticizer causes the solid lost circulation material to become deformable and adhesive in response to contacting the solid lost circulation material, wherein the solid lost circulation material contacted by the plasticizer forms a malleable plug that seals the loss zone; and after malleable plug seals the loss zone, circulating a fluid through the wellbore to further seal the plug against the loss zone to block fluid flow from the wellbore into the loss zone.

11. The method of claim 10, wherein the solid lost circulation material comprises a polymeric acid, and the plasticizer comprises acetone.

12. The method of claim 10, wherein the solid lost circulation material comprises polyethylene terephthalate, and the plasticizer comprises an ethylene-based glycol.

13. The method of claim 10, wherein a first portion of the solid lost circulation material that is flowed into the wellbore is negatively charged, and a second portion of the solid lost circulation material that is flowed into the wellbore is positively charged.

14. The method of claim 13, comprising, prior to flowing the solid lost circulation material into the wellbore, exposing the second portion of the solid lost circulation material to an electric field having a voltage in a range of from about 2 volts (V) to about 40 V.

15. The method of claim 13, wherein prior to flowing the solid lost circulation material into the wellbore, an ionic surfactant is disposed on a surface of the second portion of the solid lost circulation material.

16. The method of claim 15, wherein the ionic surfactant comprises an amine, a quaternary ammonium cation, or both.

17. A system comprising:

a wellbore formed in a subterranean formation having a loss zone;

a plug disposed in the loss zone of the subterranean formation, wherein the plug comprises:

a first solid lost circulation material having a negative charge; and a second solid lost circulation material having a positive charge, the second solid lost circulation material in contact with the first solid lost circulation based on an attraction between the negative charge and the positive charge of the first solid lost circulation material and the second solid lost circulation material, respectively;

a plasticizer disposed in the loss zone of the subterranean formation, wherein the plasticizer is configured to cause the second solid lost circulation material to become deformable and adhesive in response to contacting the second solid lost circulation material to make the plug malleable and seal the loss zone; and a pump configured to flow, separately, the first solid lost circulation material, the second solid lost circulation material, and the plasticizer into the wellbore to the loss zone of the subterranean formation.

18. The system of claim 17, wherein the second solid lost circulation material comprises a polymeric acid, and the plasticizer comprises acetone.

19. The system of claim 18, wherein the second solid lost circulation material comprises an ionic surfactant disposed on a surface of the polymeric acid, and the ionic surfactant comprises an amine, a quaternary ammonium cation, or both.

* * * * *